US008081202B2

(12) United States Patent
Tojima

(10) Patent No.: US 8,081,202 B2
(45) Date of Patent: Dec. 20, 2011

(54) IMAGE FORMING APPARATUS AND APPARATUS FOR CORRECTING DIFFERENCE IN OSCILLATION SPEED AMONG OSCILLATING DEVICES

(75) Inventor: Kenzo Tojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 703 days.

(21) Appl. No.: 12/182,033

(22) Filed: Jul. 29, 2008

(65) Prior Publication Data

US 2009/0035001 A1 Feb. 5, 2009

(30) Foreign Application Priority Data

Aug. 3, 2007 (JP) ..... 2007-203401

(51) Int. Cl.
*B41J 2/435* (2006.01)
*B41J 2/47* (2006.01)
*B41J 15/14* (2006.01)

(52) U.S. Cl. ..... 347/234; 347/229; 347/248

(58) Field of Classification Search ..... 347/229, 347/231, 234, 235, 243, 248–250, 259, 260
See application file for complete search history.

(56) References Cited

U.S. PATENT DOCUMENTS

2004/0120023 A1* 6/2004 Bush et al. ..... 359/213

FOREIGN PATENT DOCUMENTS

JP 2003-266774 A 9/2003
JP 2005-181655 A 7/2005
JP 2007-171854 A 7/2007

* cited by examiner

*Primary Examiner* — Hai C Pham

(57) ABSTRACT

An image forming apparatus includes a device-information storage unit configured to store a scanning frequency of an oscillating device; an image storage unit configured to store image data used for image formation; an image processing unit configured to perform an enlargement or reduction, in a direction orthogonal to a direction of the scanning of the laser beam and in accordance with a given parameter, on the image data stored in the image storage unit; a setting unit configured to calculate the parameter from the scanning frequency stored in the device-information storage unit and a predetermined reference frequency and configured to provide the parameter to the image processing unit; and a driving unit configured to drive a laser beam device according to the image data processed by the image processing unit.

13 Claims, 15 Drawing Sheets

$$\frac{1}{x} : \frac{1}{y} = a : b$$

IMAGE FORMING APPARATUS AND APPARATUS FOR CORRECTING DIFFERENCE IN OSCILLATION SPEED AMONG OSCILLATING DEVICES

BACKGROUND OF THE INVENTION

1. Field of the Invention

The present invention relates to a technology for improving the quality of images formed using an electrophotography process.

2. Description of the Related Art

A typical known image forming apparatus that uses an electrophotography process causes an oscillating or rotating laser scanner to reflect a light beam modulated by a pixel signal onto a rotating photosensitive body to form an electrostatic latent image. In such an image forming apparatus, movement fluctuations of each movable component can distort an image to be formed. For example, speed fluctuations of an image bearing member cause color misregistration.

Japanese Patent Laid-Open No. 2005-181655, for example, discloses an image forming apparatus that reduces color misregistration caused by speed fluctuations of an image bearing member. More specifically, the image forming apparatus detects the rotational speed of an intermediate transfer belt and performs an interpolation process for adding scanning lines or a decimation process for reducing scanning lines.

However, when image forming apparatuses use devices whose scanning frequency can vary or change as laser scanners, the sub-scanning width (the distance between two adjacent main scanning lines) can vary among the image forming apparatuses. When micro electromechanical system (MEMS) scanners, which are small and low-priced oscillating devices, are used as the laser scanners, the scanning frequency may vary among the MEMS scanners and may change with the passage of time. Although it is technically possible to perform feedback control on the MEMS scanners having natural frequencies to correct their scanning frequency, it involves high cost.

Accordingly, in an image forming apparatus that uses a plurality of MEMS scanners corresponding to colors, variation in scanning frequency among the MEMS scanners causes variation in sub-scanning width among the colors, i.e., color misregistration, on a sheet of transfer material. This makes it difficult to obtain a high-quality full color image.

SUMMARY OF THE INVENTION

An image forming apparatus according to an embodiment of the present invention includes an oscillating device configured to oscillate at a natural frequency; a laser beam device configured to emit a laser beam; a photoconductive drum, the oscillating device configured to scan the laser beam from the laser beam device across the photoconductive drum; a device-information storage unit configured to store a scanning frequency of the oscillating device; an image storage unit configured to store image data used for image formation; an image processing unit configured to perform an enlargement or reduction, in a direction orthogonal to a direction of the scanning of the laser beam and in accordance with a parameter, on the image data stored in the image storage unit; a setting unit configured to calculate the parameter from the scanning frequency stored in the device-information storage unit and a predetermined reference frequency and configured to set the parameter in the image processing unit; and a driving unit configured to drive the laser beam device according to the image data processed by the image processing unit.

Further features of the present invention will become apparent from the following description of exemplary embodiments with reference to the attached drawings.

DESCRIPTION OF THE EMBODIMENTS

Figure 1:
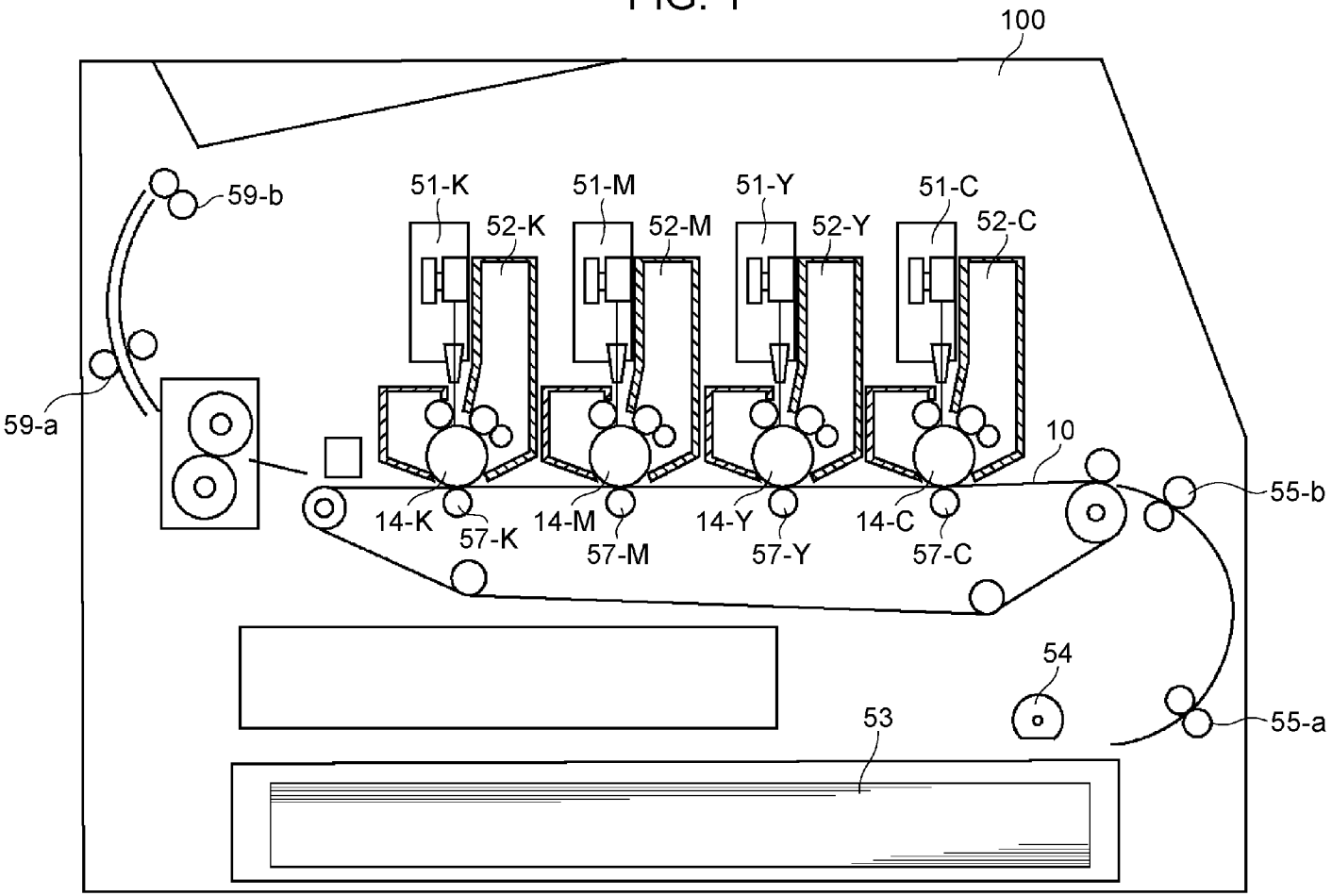
FIG. 1 is a schematic sectional view of an image forming apparatus according to a first embodiment of the present invention.

Embodiments of the present invention will now be described in detail with reference to the drawings. The embodiments described below are by way of example only and not limitations on the scope of the invention.

First Embodiment

An image forming apparatus according to the first embodiment of the present invention, which uses four colors of toner, namely, cyan (C), yellow (Y), magenta (M), and black (K), will now be described. Reference numerals with one of the letters C, M, Y, and K respectively denote functional sections corresponding to cyan, yellow, magenta, and black.

Structure of Apparatus

FIG. 1 is a schematic sectional view of an image forming apparatus according to the first embodiment. This image forming apparatus is, for example, a color laser-beam printer that has four drums for C, M, Y, and K.

An image forming apparatus 100 has a transfer material cassette 53 at the bottom of the body. A feeding roller 54 picks up transfer material, such as sheets, contained in the transfer material cassette 53 on a piece-by-piece basis. The transfer material is conveyed to image forming sections for C, M, Y, and K by pairs of conveying rollers 55-*a* and 55-*b*.

Figure 2:
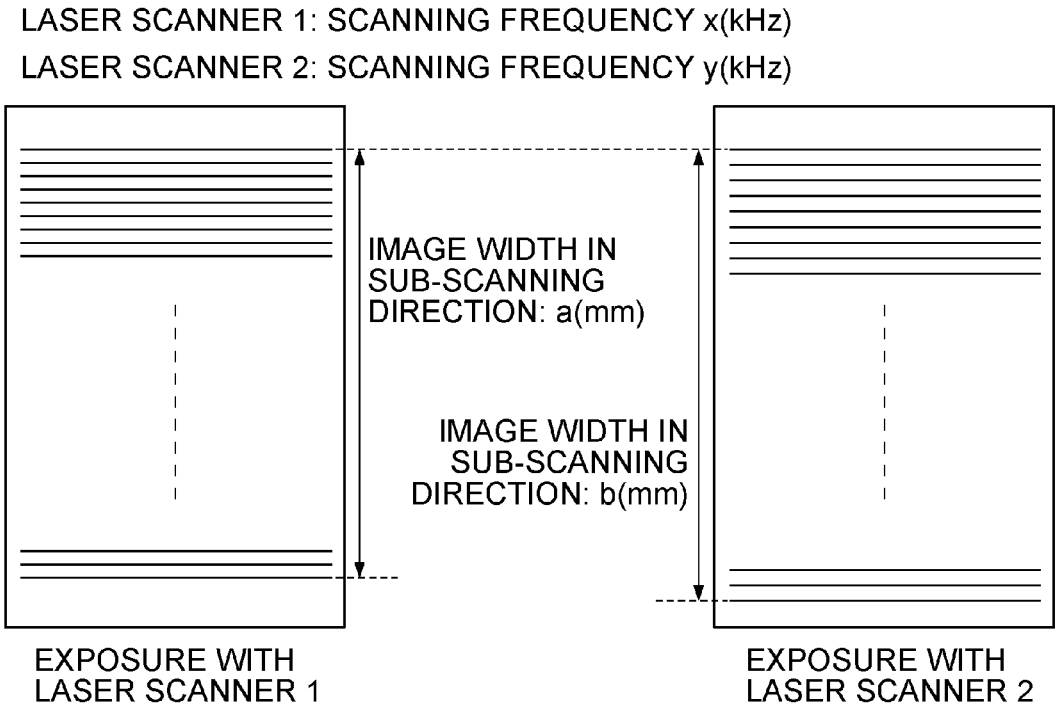
FIG. 2 is a diagram showing a difference in sub-scanning width between two images, caused by a difference in scanning frequency between two laser scanners.

A conveying belt 10 (that conveys the transfer material in the direction from right to left in FIG. 2) runs in FIG. 1 horizontally around a plurality of rollers near the image forming sections. Four photosensitive drums 14, each corresponding to one of C, M, Y, and K, are provided in a line so as to face the conveying surface of the conveying belt 10.

Each of the image forming sections includes an exposure unit 51, a developing unit 52, a photosensitive drum 14, toner, a charger, and a developer. The charger and the developer are contained in the housing of the developing unit 52 with a predetermined clearance therebetween. The exposure unit 51 (driving unit) that includes a laser scanner charges the peripheral surface of the photosensitive drum 14 to a predetermined charge level by irradiating it through the clearance with a light beam emitted from a laser beam device.

Herein, MEMS scanners, which are oscillating devices having natural oscillation frequency (natural oscillation speed), are used as laser scanners. The MEMS scanners are oscillating devices that cyclically oscillate about the axis. The exposure units 51 expose the peripheral surfaces of the charged photosensitive drums 14 according to image information and form electrostatic latent images. The developers transfer toner onto the electrostatic latent images to form (develop) toner images.

Transferring members 57 are located opposite the photosensitive drums 14 with the conveying belt 10 therebetween. The transferring members 57 generate a transferring electric field, which causes the toner images formed on the peripheral surfaces of the photosensitive drums 14 to transfer to the surface of the conveyed transfer material. The transfer material is then output from the image forming apparatus 100 by pairs of paper-output rollers 59-*a* and 59-*b*. The conveying belt 10 may serve as an intermediate transfer belt that temporarily receives toner of C, M, Y, and K and then transfers it to the transfer material (secondary transfer).

In the following description, a direction in which the exposure units 51 scan the photosensitive drums 14 with light beams is referred to as a "main scanning direction". The MEMS scanners serve to scan light beams in the main scanning direction. A direction in which the conveying belt 10 conveys transfer material is referred to as a "sub-scanning direction". The main scanning direction and the sub-scanning direction are orthogonal to each other.

FIG. 2 is a diagram showing a difference in sub-scanning width between two images. The difference in sub-scanning width is caused by a difference in scanning frequency between two laser scanners.

There is provided one conveying belt 10. The photosensitive drums 14 for C, M, Y, and K, which serve as image bearing members, rotate at the same speed. Variation in scanning frequency among the laser scanners for C, M, Y, and K varies the time required to complete one scanning among them, resulting in variation in sub-scanning width of the latent and toner images among C, M, Y, and K. As a result, when transferred to transfer material, the C, M, Y, and K toner images become misregistered with each other on the transfer material, leading to color misregistration.

The relational expression "1/x:1/y=a:b" (read 1/x is to 1/y as a is to b) holds true where the scanning frequencies (reciprocal of cycle) of laser scanners 1 and 2 are x (kHz) and y (kHz), respectively, and the sub-scanning widths of electrostatic latent images exposed with the laser scanners 1 and 2 are a (mm) and b (mm), respectively.

Reduction of Color Misregistration by Controlling Exposure Unit

As described above, the image forming apparatus 100 according to the first embodiment has the image forming sections for C, M, Y, and K each having the exposure unit 51 containing the MEMS scanner. Thus, the sub-scanning widths of the C, M, Y, and K images need to be made equal to each other. The image forming apparatus according to the first embodiment uses the sub-scanning width of a K image as the reference and controls formation of C, M, and Y images to reduce color misregistration. More specifically, the C, M, and Y images are enlarged or reduced in the sub-scanning direction so that their sub-scanning widths match that of the K image to reduce the color misregistration.

Figure 3:
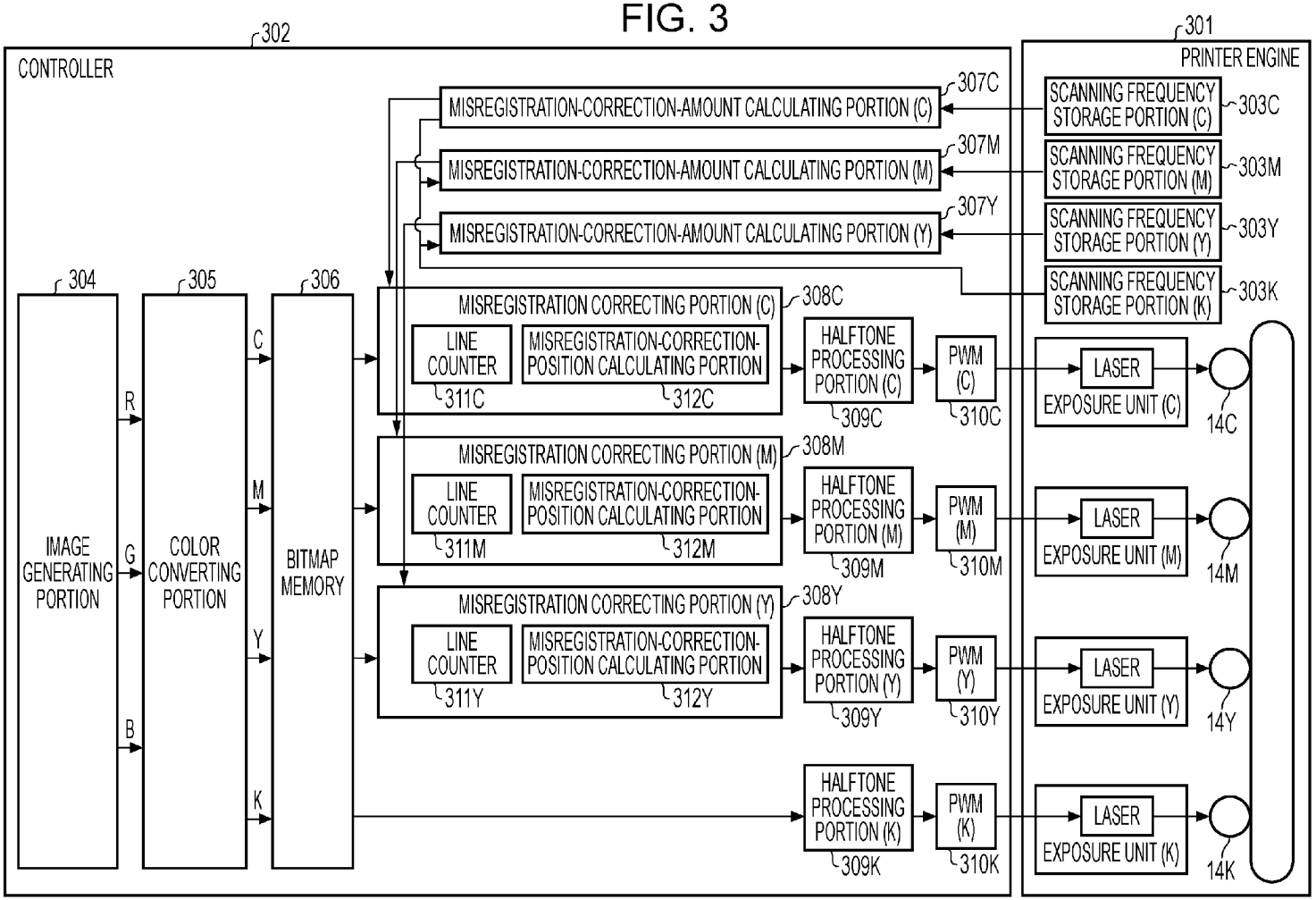
FIG. 3 is a logical block diagram showing control of an exposure unit according to the first embodiment.

FIG. 3 is a logical block diagram showing control of an exposure unit according to the first embodiment.

A printer engine 301 is a functional section corresponding to the exposure units 51 that form images according to image data (raster image data) generated by a controller 302. Scanning frequency storage portions (device-information storage unit) 303 store the scanning frequency of the MEMS scanners provided in the exposure units 51.

The scanning frequency of the MEMS scanners may be stored in the scanning frequency storage portions 303 in the manufacturing process of the image forming apparatus 100. Alternatively, in order to take into account changes in scanning frequency of the MEMS scanners with the passage of time, the scanning frequency of the MEMS scanners may be detected and measured by a detection mechanism and a measuring mechanism, and then stored in the scanning frequency storage portions 303 at a predetermined timing. Examples of such a predetermined timing include when the image forming apparatus 100 is turned on (during warm-up), and when a predetermined period of time (for example, one day) has passed after the image forming apparatus 100 is turned on.

The controller 302 is a functional section that regenerates image data to be output to the printer engine 301 according to the information about the scanning frequencies stored in the scanning frequency storage portions 303.

The image generating portion 304 generates raster image data from print data received from a computer apparatus or the like (not shown). For example, the image generating portion 304 outputs RGB data per dot. A color converting portion 305 converts the RGB data generated by the image generating portion 304 to raster image data of the CMYK space, so that the printer engine 301 can process the data.

A bitmap memory (image storage unit) 306 is a functional section that temporarily stores the raster image data to be printed. A bitmap memory that stores image data equivalent to one page is called a "page memory", and a bitmap memory that stores data equivalent to several lines is called a band memory.

Misregistration-correction-amount calculating portions (setting unit) 307 calculate the enlargement or reduction factors in the sub-scanning direction from the information about the scanning frequencies stored in the scanning frequency storage portions 303. More specifically, the misregistration-correction-amount calculating portions 307C, 307M, and 307Y calculate the enlargement or reduction factors (correction amount) that make the sub-scanning widths of colored images formed by the exposure units 51C, 51M, and 51Y for cyan, magenta, and yellow match the sub-scanning width of an image formed by the exposure unit 51K for black. Then, the misregistration-correction-amount calculating portions 307C, 307M, and 307Y output the calculated enlargement or reduction factors to misregistration correcting portions 308C, 308M, and 308Y, respectively. In other words, the enlargement or reduction factors output to the misregistration correcting portion 308 serve as parameters.

More specifically, where the scanning frequencies of the MEMS scanners for C, M, Y, and K are C_T (kHz), M_T (kHz), Y_T (kHz), and K_T (kHz), respectively, the enlargement or reduction factors C_S, M_S, Y_S, and K_S for C, M, Y, and K, respectively, are expressed as follows:

$$C_S=C_T/K_T$$

$$M_S=M_T/K_T$$

$$Y_S=Y_T/K_T$$

$$K_S=K_T/K_T=1$$

In a color that uses a MEMS scanner having a high scanning frequency, the decreased sub-scanning width is corrected by enlarging the image data in the sub-scanning direction. In contrast, in a color that uses a MEMS scanner having a low scanning frequency, the increased sub-scanning width is corrected by reducing the image data in the sub-scanning direction.

The misregistration correcting portions (image processing unit) 308 generate image data for correcting variation in scanning frequency among the MEMS scanners for C, M, Y and K, and correct color misregistration caused by variation in sub-scanning width among C, M, Y, and K. More specifically, using the bitmap data stored in the bitmap memory 306 and the enlargement or reduction factors input from the misregistration-correction-amount calculating portions 307, the misregistration correcting portions 308 generate image signals enlarged or reduced in the sub-scanning direction. Additional detail regarding FIG. 3 will be provided below.

Figure 4:
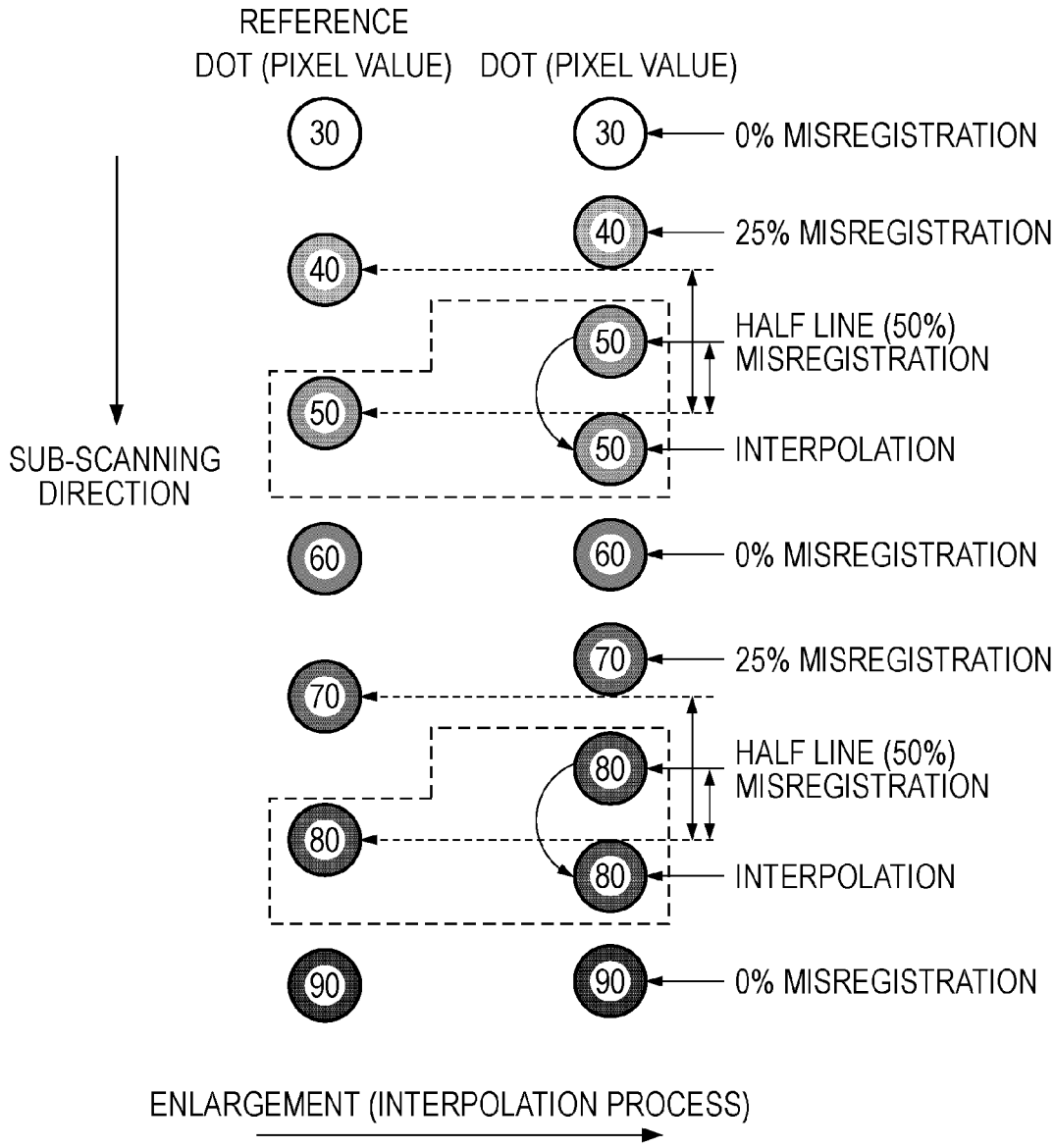
FIG. 4 shows an operation in enlargement (overlapping data interpolation process).

FIG. 4 shows an operation in enlargement. It is assumed that the scanning frequency of the MEMS scanner for cyan (C) is that for black (K), which serves as the reference, multiplied by 4/3 (=1.33). The circles in FIG. 4 represent pixels, and the numbers in the circles represent exemplary pixel values. As shown in FIG. 4, a length equivalent to three sub-scanning widths of the black image equals to a length equivalent to four sub-scanning widths of the cyan image. Every third line of the main scanning lines of the black image and every fourth line of the main scanning lines of the cyan image align. Thus, the interval between the main scanning lines of the cyan image is smaller than that of the black image by 25%.

To compensate for this, overlapping data is interpolated into the cyan image every four lines (overlapping interpolation process). As shown in FIG. 4, when the amount of misregistration between the corresponding lines of the black and cyan images becomes half a line (in FIG. 4, 50%), a line having the same line image data (line image signal) as the preceding line is interpolated into the cyan image to correct the accumulated misregistration. In short, by enlarging the image in the sub-scanning direction, the decrease in sub-scanning width is corrected.

Figure 5:
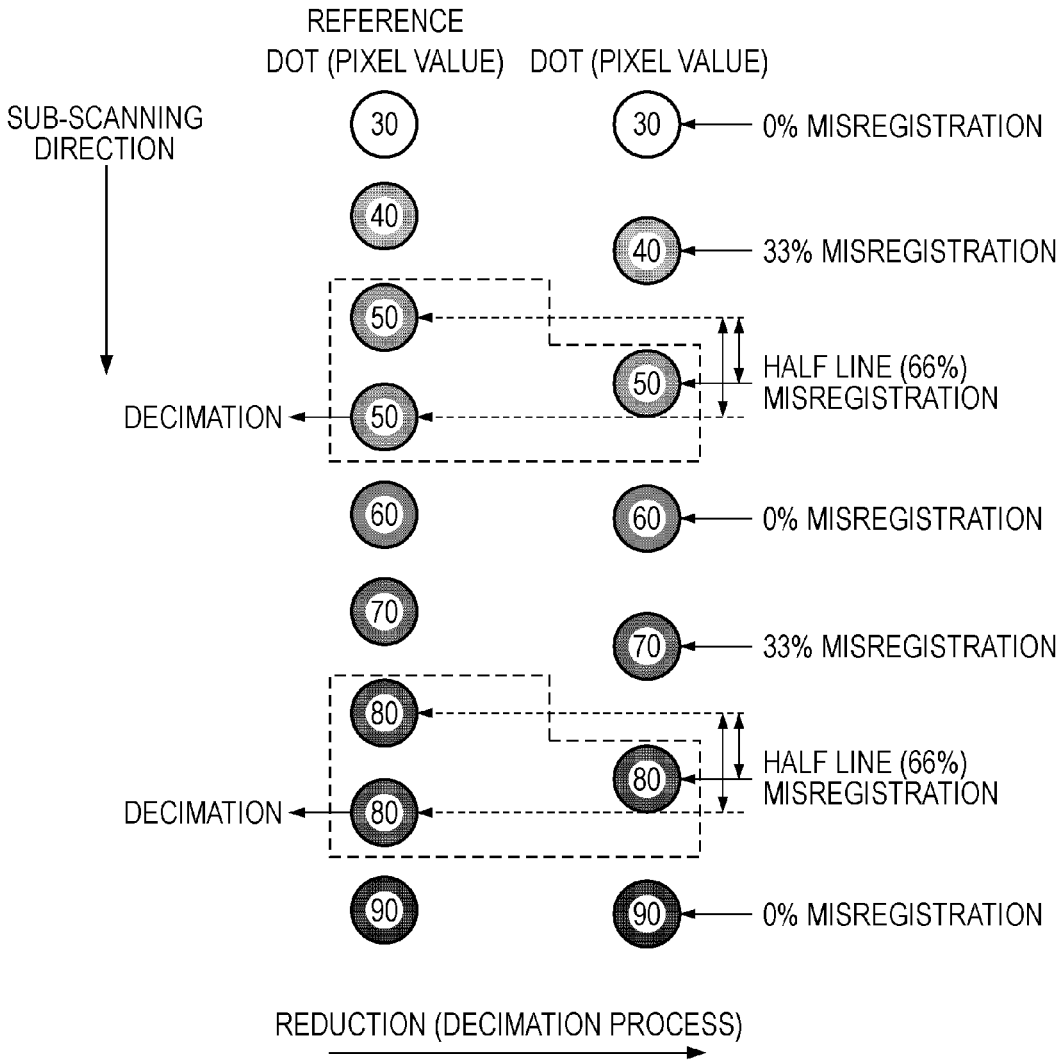
FIG. 5 shows an operation in reduction (decimation process).

FIG. 5 shows an operation in reduction. It is assumed that the scanning frequency of the MEMS scanner for magenta (M) is that for black (K), which serves as the reference, multiplied by 3/4 (=0.75). In this case, as shown in FIG. 5, a length equivalent to four sub-scanning widths of the black image equals to a length equivalent to three sub-scanning widths of the magenta image. Every fourth line of the main scanning lines of the black image and every third line of the main scanning lines of the magenta image align. Thus, the interval between the main scanning lines of the magenta image is larger than that of the black image by 33%.

To compensate for this, a line is decimated from the magenta image every four lines. As shown in FIG. 5, when the amount of misregistration between the corresponding lines of the black and magenta images becomes half a line (in FIG. 5, 66%), line image data of the subsequent line is decimated from the magenta image to correct the accumulated misregistration. In short, by reducing the image in the sub-scanning direction, the increase in sub-scanning width is corrected.

Now, referring back to FIG. 3, creation of a correction bitmap by enlargement or reduction of images will be described.

The misregistration correcting portions 308 each have a line counter 311 and a misregistration-correction-position calculating portion 312. The misregistration-correction-position calculating portion 312 calculates the position of the line to be interpolated or decimated. The calculation is based on the enlargement or reduction factor calculated by the corresponding misregistration-correction-amount calculating portion 307 and the total number of lines of the image bitmap data. The line counter 311 stores the position of the line of the bitmap memory 306 that the misregistration correcting portion 308 refers to.

The misregistration correcting portion 308 refers to the line counter 311 and reads the line from the bitmap memory 306 twice at the position of the line where interpolation is to be performed, which was calculated by the misregistration-correction-position calculating portion 312. The misregistration correcting portion 308 refers to the line counter 311 and skips reading of the line from the bitmap memory 306 at the position of the line where decimation is to be performed, which was calculated by the misregistration-correction-position calculating portion 312.

The image data corrected through the aforementioned process are subject to halftone processing at halftone processing portions 309 and pulse-width modulation processing at PWM portions 310, and then output to the printer engine 301, where the photosensitive drums 14 serving as image bearing members are exposed.

As has been described, the image forming apparatus according to the first embodiment enlarges or reduces the image data of yellow, magenta, and cyan in the sub-scanning direction while using the sub-scanning width corresponding to the scanning frequency of the MEMS scanner for black as the reference, to reduce color misregistration, i.e., to reduce the influence of variation in scanning frequency among the MEMS scanners on image formation.

Because human eyes easily recognize black, if the above-described interpolation or decimation process is performed on the black image, a user may notice degradation of image quality. Accordingly, it is desirable that the above-described interpolation or decimation process be performed not on the black image, but on the images of the other colors (C, M, and Y), which are less easily recognized by human eyes than black.

The misregistration correcting portions 308 may be configured to perform the correction only when the enlargement or reduction factors calculated by the misregistration-correction-amount calculating portions 307 exceed a predetermined range.

An image forming apparatus that uses two MEMS scanners for lasers of four colors can also reduce color misregistration through the above-described process. When a MEMS scanner 1 corresponds to K and C images and a MEMS scanner 2 corresponds to M and Y images, the image forming apparatus uses the sub-scanning width corresponding to the scanning frequency of the MEMS scanner 1 as the reference, and enlarges or reduces the M and Y images depending on the scanning frequency of the MEMS scanner 2.

Modification Example 1

An image forming apparatus according to Modification Example 1 will now be described. The image forming apparatus according to Modification Example 1 uses the sub-scanning width of the colored image formed by the exposure unit that has the laser scanner having the most ideal scanning frequency as the reference, and enlarges or reduces the image data of the other colors in the sub-scanning direction to reduce color misregistration. The image forming apparatus according to Modification Example 1 has the same configuration as that according to the first embodiment.

Figure 6:
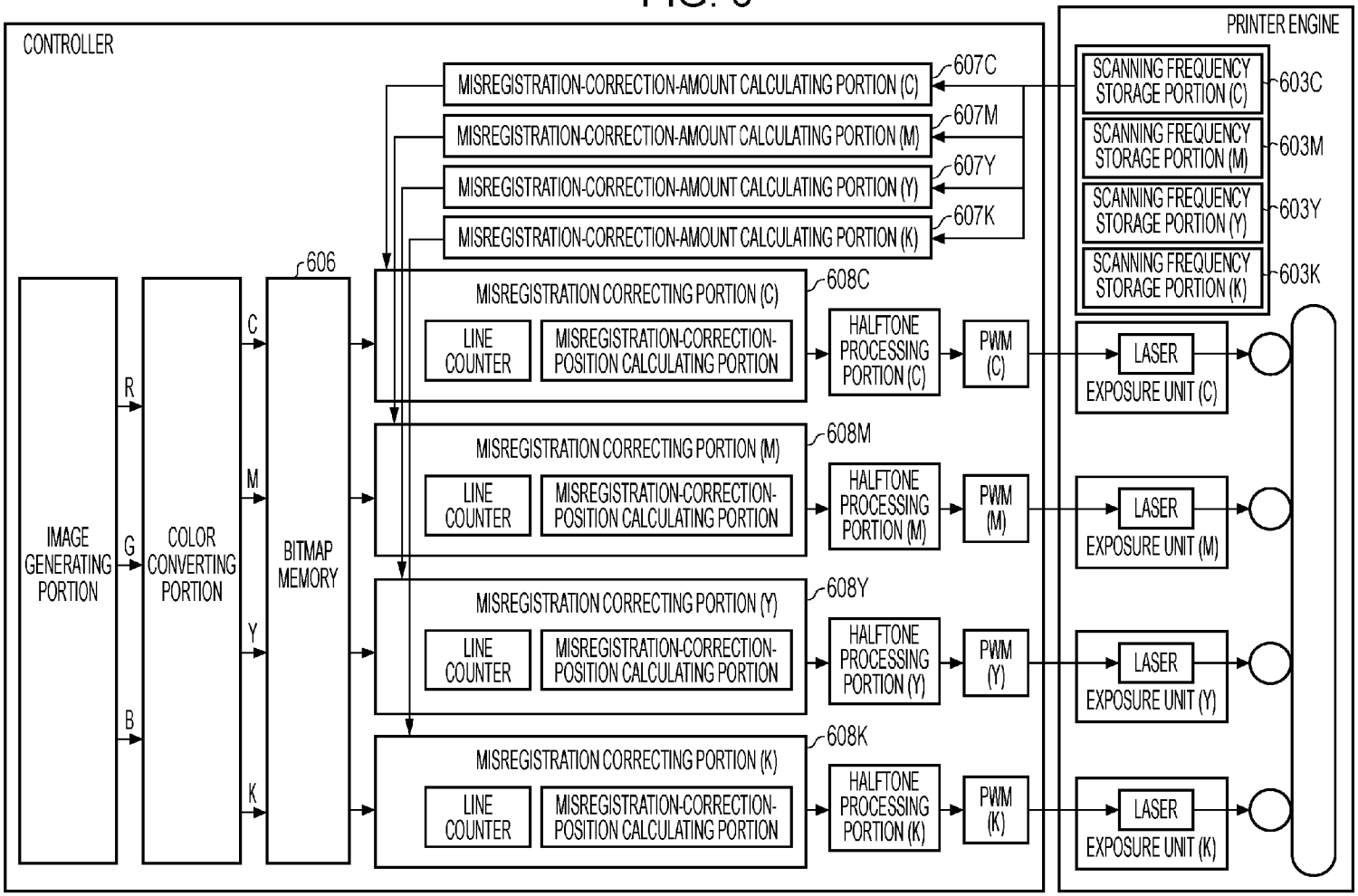
FIG. 6 is a logical block diagram showing control of an exposure unit according to Modification Example 1.

FIG. 6 is a logical block diagram showing control of an exposure unit according to Modification Example 1. The following description focuses on the difference between the Modification Example 1 and the first embodiment.

Misregistration-correction-amount calculating portions 607 calculate the enlargement or reduction factors in the sub-scanning direction from the information about the scanning frequencies stored in the scanning frequency storage portions 603. More specifically, the misregistration-correction-amount calculating portions 607 use the sub-scanning width of a colored image formed by an exposure unit that has the laser scanner whose scanning frequency is closest to the scanning frequency stored in a storage section (not shown) of the image forming apparatus as the reference to calculate the enlargement or reduction factors (correction amount) that make the sub-scanning widths of the colored images formed by the other exposure units match the reference sub-scanning width. The calculated enlargement or reduction factors are output to misregistration correcting portions 608.

The scanning frequency stored in the storage section (not shown) is a scanning frequency at which an ideal resolution in the sub-scanning direction is provided. Herein, the "ideal frequency" means a scanning frequency at which image data is output with a designated resolution, which usually depends on the rotational speed of the photosensitive drums 14.

Where the scanning frequencies of the MEMS scanners for C, M, Y, and K are C_T (kHz), M_T (kHz), Y_T (kHz), and K_T (kHz), respectively, and the most ideal scanning frequency is M_T, the enlargement or reduction factors C_S, M_S, Y_S, and K_S for C, M, Y, and K, respectively, are expressed as follows:

$$C_S=C_T/M_T$$

$$M_S=M_T/M_T=1$$

$$Y_S=Y_T/M_T$$

$$K_S=K_T/M_T$$

If the most ideal scanning frequency is not M_T (magenta), then replace the denominators on the right-hand side of the above expressions with the applicable scanning frequency.

The misregistration correcting portions 608 generate image data for correcting variation in scanning frequency among the MEMS scanners for C, M, Y, and K and correct color misregistration caused by variation in sub-scanning width among C, M, Y, and K. More specifically, using the bitmap data stored in the bitmap memory 606 and the enlargement or reduction factors input from the misregistration-correction-amount calculating portions 607, the misregistration correcting portions 608 generate image signals enlarged or reduced in the sub-scanning direction.

As has been described, the image forming apparatus according to Modification Example 1 uses the sub-scanning width corresponding to the scanning frequency of the MEMS scanner that has the most ideal scanning frequency as the reference, and enlarges or reduces the image data of the other colors in the sub-scanning direction to reduce color misregistration, i.e., to reduce the influence of variation in scanning frequency among the MEMS scanners on image formation.

Modification Example 2

An image forming apparatus according to Modification Example 2 will now be described. The image forming apparatus according to Modification Example 2 uses the sub-scanning width of the colored image formed by the exposure unit that has the laser scanner having the maximum scanning frequency as the reference, and enlarges or reduces the image data of the other colors in the sub-scanning direction to reduce color misregistration. The image forming apparatus according to Modification Example 2 has the same configuration as that according to the first embodiment.

Like Modification Example 1, control of the exposure units will be described with reference to FIG. 6.

Misregistration-correction-amount calculating portions 607 calculate the enlargement or reduction factors in the sub-scanning direction from the information about the scanning frequencies stored in the scanning frequency storage portions 603. More specifically, using the sub-scanning width of the colored image formed by the exposure unit that has the laser scanner having the maximum scanning frequency among the scanning frequencies stored in the scanning frequency storage portions 603 as the reference, the misregistration-correction-amount calculating portions 607 calculate the enlargement or reduction factors (correction amount) that make the sub-scanning widths of the colored images formed by the other exposure units match the reference sub-scanning width. The calculated enlargement or reduction factors are output to the misregistration correcting portions 608.

Where the scanning frequencies of the MEMS scanners for C, M, Y, and K are C_T (kHz), M_T (kHz), Y_T (kHz), and K_T (kHz), respectively, and the maximum scanning frequency is M_T, the enlargement or reduction factors C_S, M_S, Y_S, and K_S for C, M, Y, and K, respectively, are expressed as follows, like Modification Example 1:

$$C_S=C_T/M_T$$

$$M_S=M_T/M_T=1$$

$$Y_S=Y_T/M_T$$

$$K_S=K_T/M_T$$

Note that because the M_T is the maximum scanning frequency, C_S, Y_S, and K_S are less than 1. This provides an advantage in that the misregistration correcting portions 608 do not have to switch between enlargement and reduction according to the color, but have to perform only reduction.

Although the maximum scanning frequency is used as the reference in the above description, the minimum scanning frequency may alternatively be used as the reference. In that case, the misregistration correcting portions 608 have to perform only enlargement.

Thus, the use of the maximum or minimum scanning frequency as the reference simplifies the processing performed by the misregistration correcting portions 608.

Modification Example 3

An image forming apparatus according to Modification Example 3 will now be described. The image forming apparatus according to Modification Example 3 uses the sub-scanning width corresponding to a predetermined ideal scanning frequency as the reference, and enlarges or reduces the image data of the C, M, Y, and K in the sub-scanning direction to reduce color misregistration. Like Modification Example 1, the "ideal frequency" means a scanning frequency at which image data is output with a designated resolution.

Figure 7:
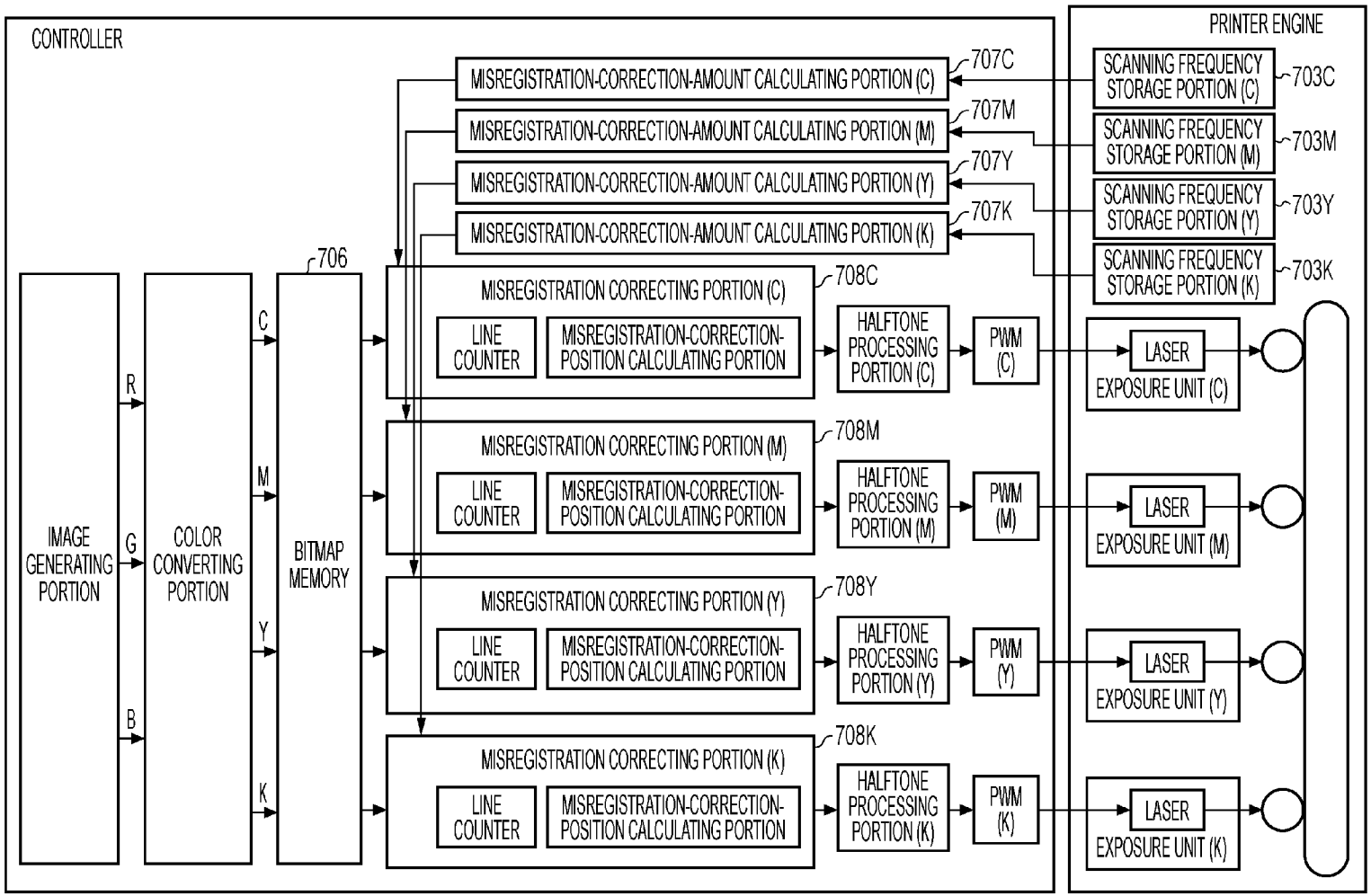
FIG. 7 is a logical block diagram showing control of an exposure unit according to Modification Example 3.

FIG. 7 is a logical block diagram showing control of an exposure unit according to Modification Example 3.

Misregistration-correction-amount calculating portions 707 calculate the enlargement or reduction factors in the sub-scanning direction from the information about the scanning frequencies stored in scanning frequency storage portions 703. More specifically, the misregistration-correction-amount calculating portions 707 calculate the enlargement or reduction factors (correction amount) that make the sub-scanning widths of the colored images formed by the exposure units for C, M, Y, and K match the sub-scanning width corresponding to the ideal scanning frequency preliminarily stored in a storage section (not shown) of the image forming apparatus. Then, the calculated enlargement or reduction factors are output to misregistration correcting portions 708.

More specifically, where the scanning frequencies of the MEMS scanners for C, M, Y, and K are C_T (kHz), M_T (kHz), Y_T (kHz), and K_T (kHz), respectively, and the ideal scanning frequency is I_T, the enlargement or reduction factors C_S, M_S, Y_S, and K_S for C, M, Y, and K, respectively, are expressed as follows:

$$C_S=C_T/I_T$$

$$M_S=M_T/I_T$$

$$Y_S=Y_T/I_T$$

$$K_S=K_T/I_T$$

The misregistration correcting portions 708 generate image data for correcting variation in scanning frequency among the MEMS scanners for C, M, Y, and K and correct color misregistration caused by variation in sub-scanning width among C, M, Y, and K. More specifically, the misregistration correcting portions 708 generate image signals enlarged or reduced in the sub-scanning direction, using the bitmap data stored in the bitmap memory 706 and the enlargement or reduction factors input from the misregistration-correction-amount calculating portions 707.

As has been described, the image forming apparatus according to Modification Example 3 uses the sub-scanning width corresponding to the ideal scanning frequency as the reference, and enlarges or reduces the image data of the C, M, Y, and K in the sub-scanning direction to reduce color misregistration, i.e., to reduce the influence of variation in scanning frequency among the MEMS scanners on image formation.

Second Embodiment

An image forming apparatus according to the second embodiment, which enlarges or reduces images by linear interpolation, will be described. The image forming apparatus according to the second embodiment has the same configuration as that according to the first embodiment.

Figure 11A:
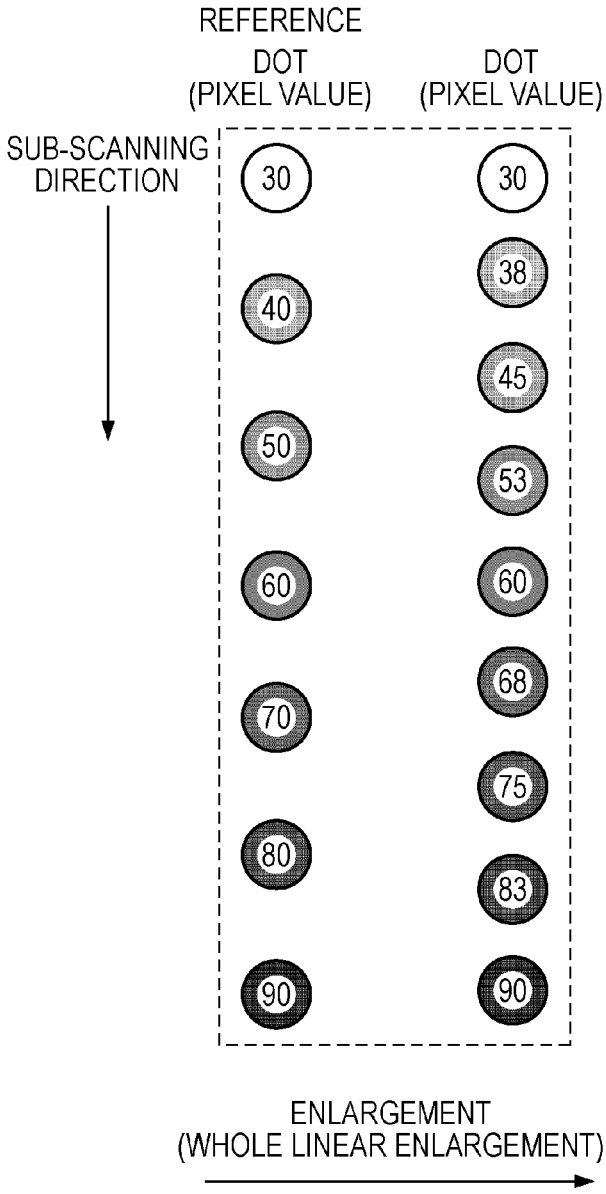
FIGS. 11A and 11B show whole linear enlargement and whole linear reduction, respectively, performed by a misregistration correcting portion.
Figure 11B:
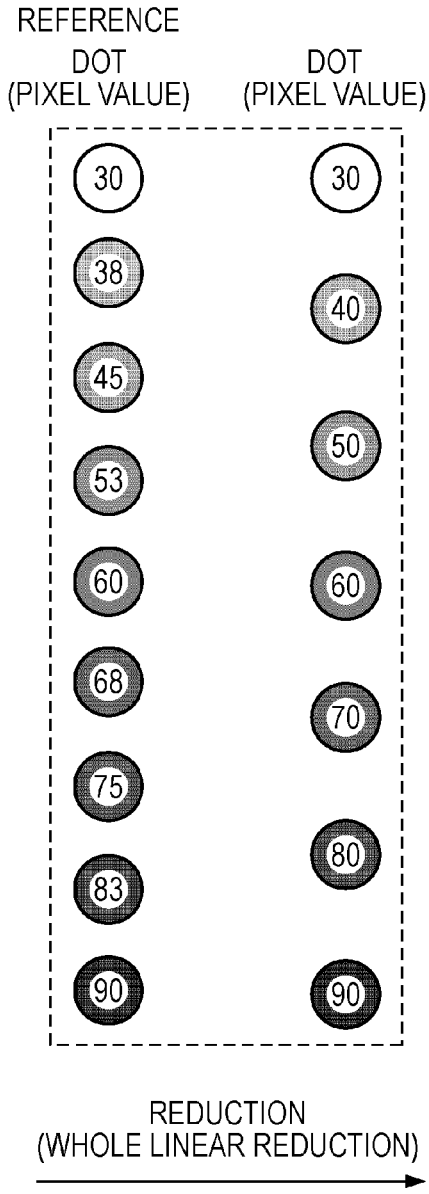
Figure 12A:
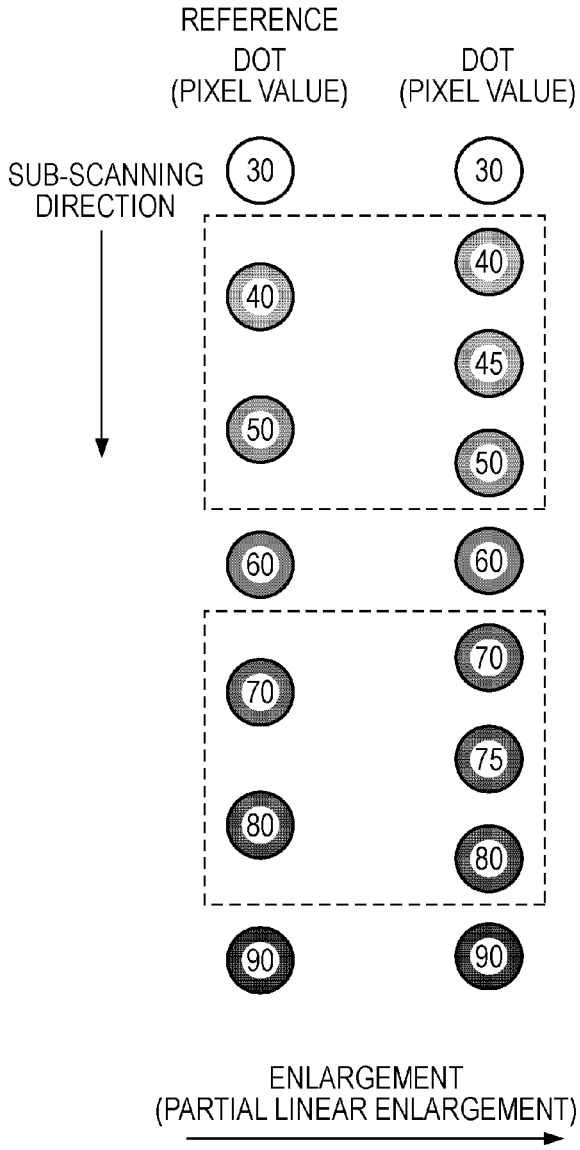
FIGS. 12A and 12B show partial linear enlargement and partial linear reduction, respectively, performed by the misregistration correcting portion.
Figure 12B:
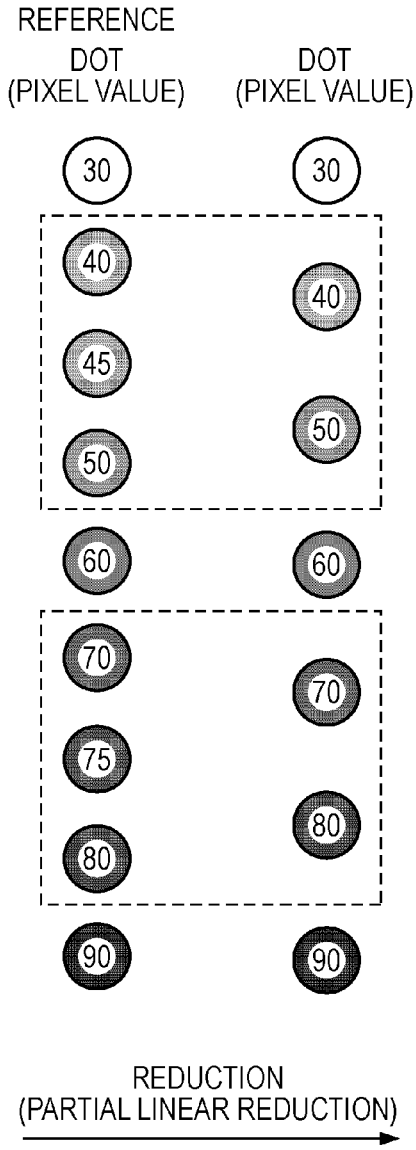

FIGS. 11A and 11B show whole linear enlargement and whole linear reduction, respectively, performed by the misregistration correcting portions. FIGS. 12A and 12B show partial linear enlargement and partial linear reduction, respectively, performed by the misregistration correcting portions. The circles in FIGS. 11A, 11B, 12A, and 12B represent pixels, and the numbers in the circles represent exemplary pixel values.

FIGS. 11A and 12A, showing enlargement, each show an exemplary case where the scanning frequency of the MEMS scanner is the reference scanning frequency multiplied by 4/3 (=1.33). FIGS. 11B and 12B, showing reduction, each show an exemplary case where the scanning frequency of the MEMS scanner is the reference scanning frequency multiplied by 3/4 (=0.75).

Figure 13:
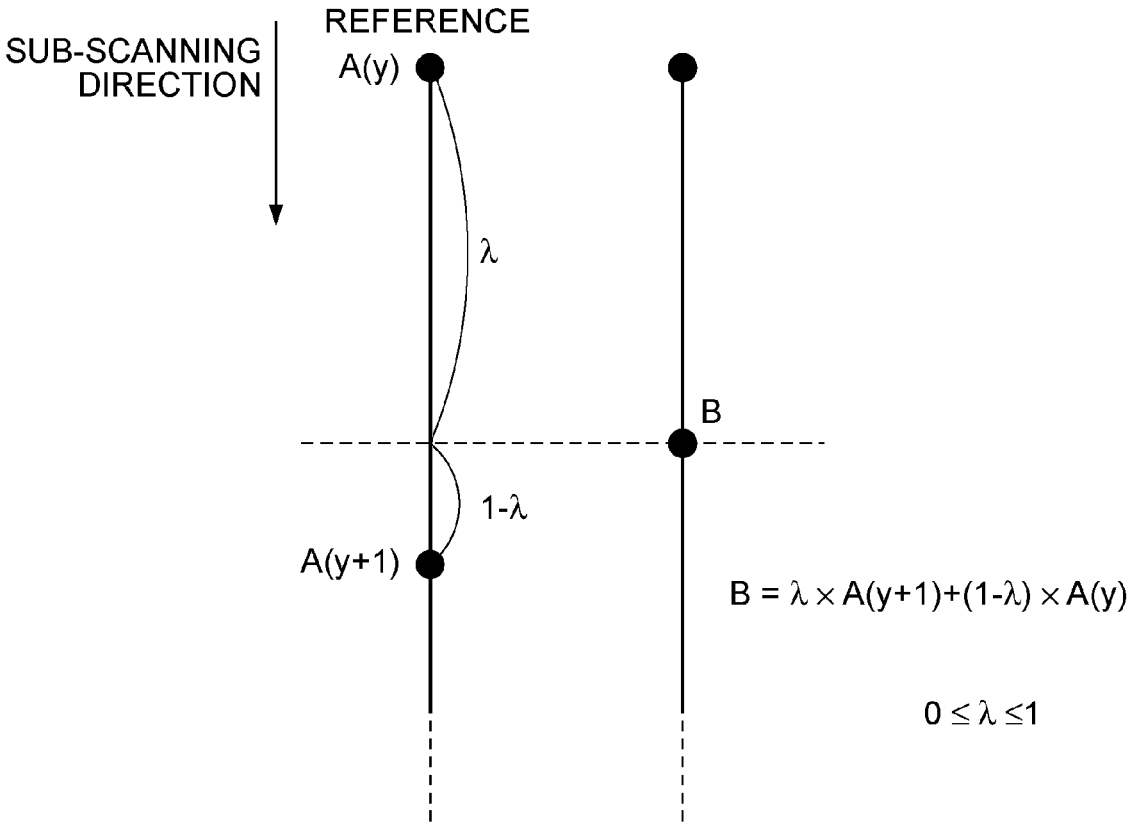
FIG. 13 shows regeneration of line data by linear enlargement.

FIG. 13 shows regeneration of line data by linear enlargement. The pixel value B at the coordinate B, which is the recording position, is derived from the pixel values A(y) and A(y+1) on the two adjacent lines (between line signals), by linear interpolation. As shown in FIG. 13, λ represents the relative length of the actual sub-scanning width, where the sub-scanning width serving as the reference is 1.

Figure 14:
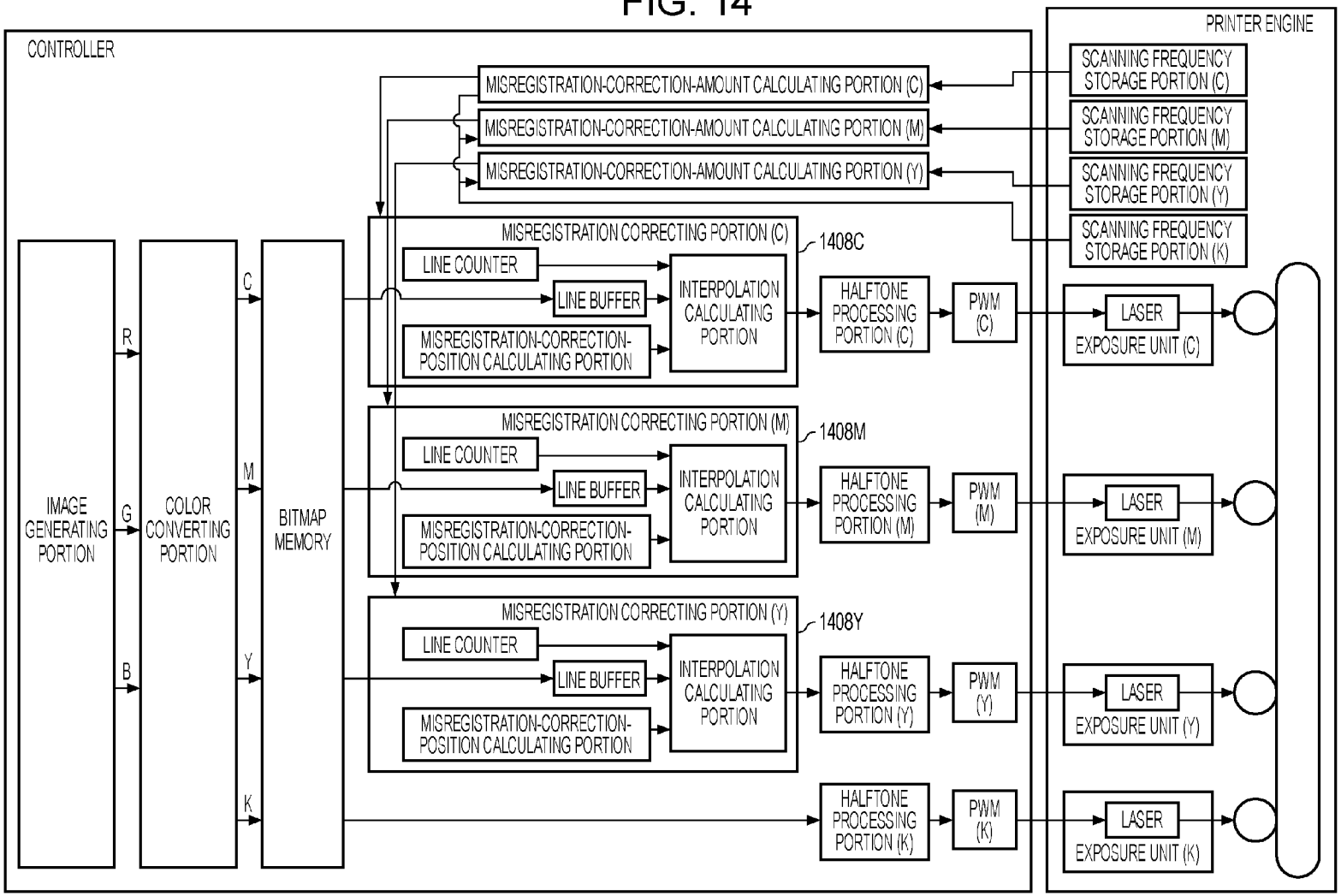
FIG. 14 is a logical block diagram showing control of an exposure unit according to a second embodiment of the present invention.
Figure 15:
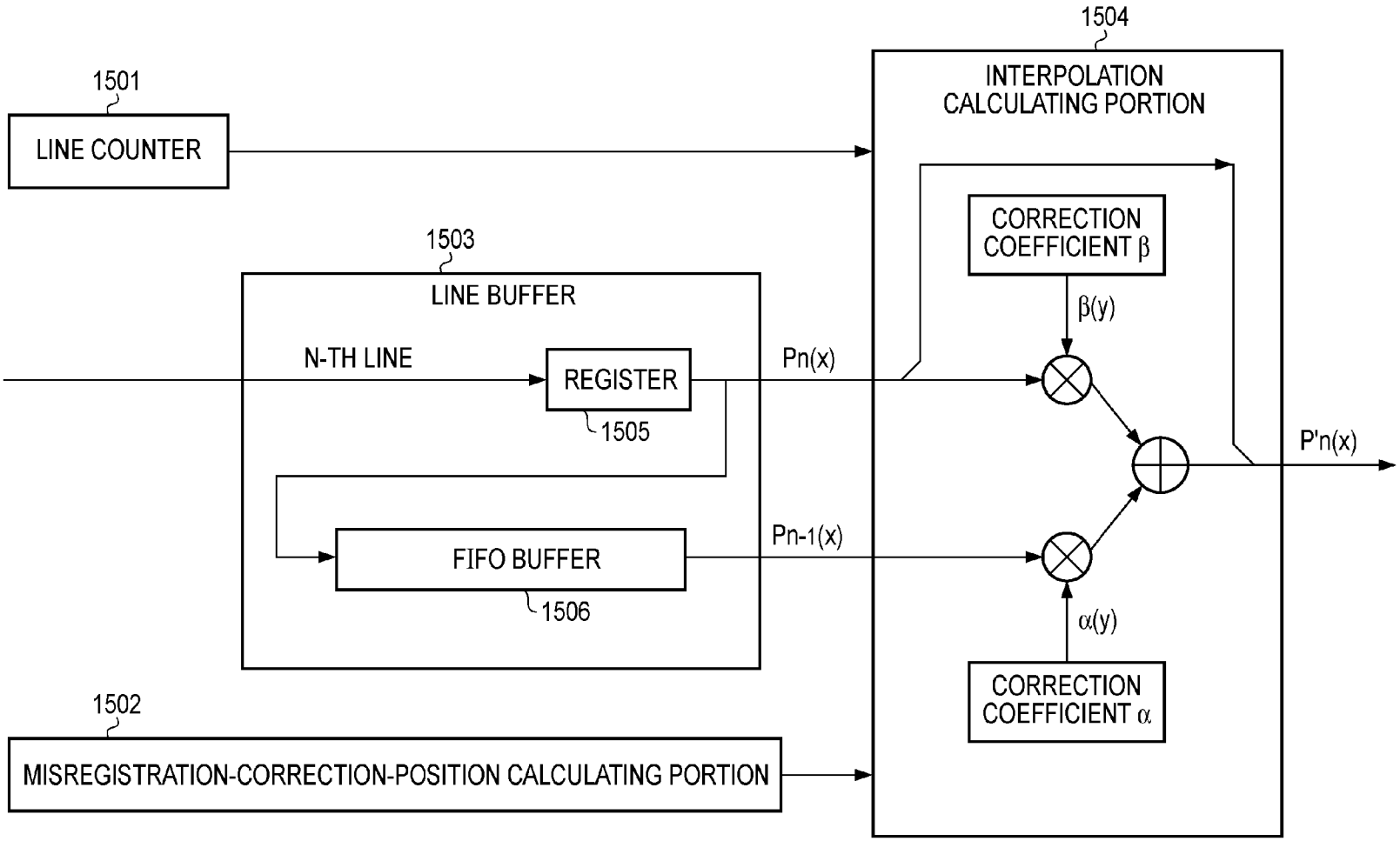
FIG. 15 is a diagram showing a detailed structure of the misregistration correcting portion.

FIG. 14 is a logical block diagram showing control of an exposure unit according to a second embodiment. Misregistration correcting portions 1408, which are different from those shown in FIG. 3, will be described. In particular, interpolation calculating portions included in the misregistration correcting portions 1408 will be described. FIG. 15 is a diagram showing a detailed structure of each misregistration correcting portion. The misregistration correcting portions 1408 are functional sections that create correction bitmaps by linear interpolation.

An interpolation calculating portion 1504 uses a line buffer 1503 for one line to refer to the antecedent and consequent pixel values in the sub-scanning direction for generation of correction data.

The line buffer 1503 includes a first-in first-out (FIFO) buffer 1506 that stores the data of the antecedent line and a register 1505 that stores the pixel data on the coordinate of the current line. The pixel data stored in the register 1505 is output to the interpolation calculating portion 1504 and also stored in the FIFO buffer 1506 so as to be used in generation of correction data for the subsequent line. Where the coordinate in the main scanning direction is x (dot), the coordinate in the sub-scanning direction is y (dot), the pixel data input from the register 1505 is Pn(x), and the pixel data input from the FIFO buffer 1506 is Pn−1(x), the interpolation calculating portion 1504 performs the following calculation to generate correction data P'n(x):

$$P'_n(x)=Pn(x)*\beta(y)+Pn-1(x)*\alpha(y),\ (\text{where } \beta(y)+\alpha(y)=1).$$

Linear interpolation may be performed on the whole image as shown in FIGS. 11A and 11B, or on a part of the image as shown in FIGS. 12A and 12B.

A misregistration-correction-position calculating portion 1502 calculates the area where linear interpolation is to be performed from the enlargement or reduction factor calculated by the misregistration-correction-amount calculating portion and the total number of lines of the image bitmap data. The interpolation calculating portion 1504 refers to a line counter 1501 and performs an interpolation calculation at the area where a linear interpolation is to be performed, which was calculated by the misregistration-correction-position calculating portion 1502. The interpolation calculating portion 1504 outputs Pn(x) as P'n(x) at the other positions. Thus, an image bitmap in which the sub-scanning width has been enlarged or reduced by linear interpolation is output.

As has been described, the image forming apparatus according to the second embodiment uses the sub-scanning width corresponding to the scanning frequency of the MEMS scanner for black as the reference, and enlarges or reduces the image data of yellow, magenta, and cyan in the sub-scanning direction to reduce color misregistration. In particular, the use of linear interpolation further reduces degradation of image quality caused by enlargement or reduction.

Third Embodiment

An image forming apparatus according to the third embodiment, which enlarges or reduces images by linear interpolation, will be described. The image forming apparatus according to the third embodiment is different from that according to the first embodiment in that one MEMS scanner is concurrently shared by laser beams corresponding to C, M, Y, and K coloring materials.

In this embodiment, color misregistration theoretically does not occur because C, M, Y, and K have the same scanning frequencies. However, when the operation frequency of the MEMS scanner is different from the reference scanning frequency, the aspect ratio of an image formed on a recording medium, such as a sheet, slightly changes. In other words, the correct ratio of the main scanning direction to the sub-scanning direction cannot be maintained.

Figure 8:
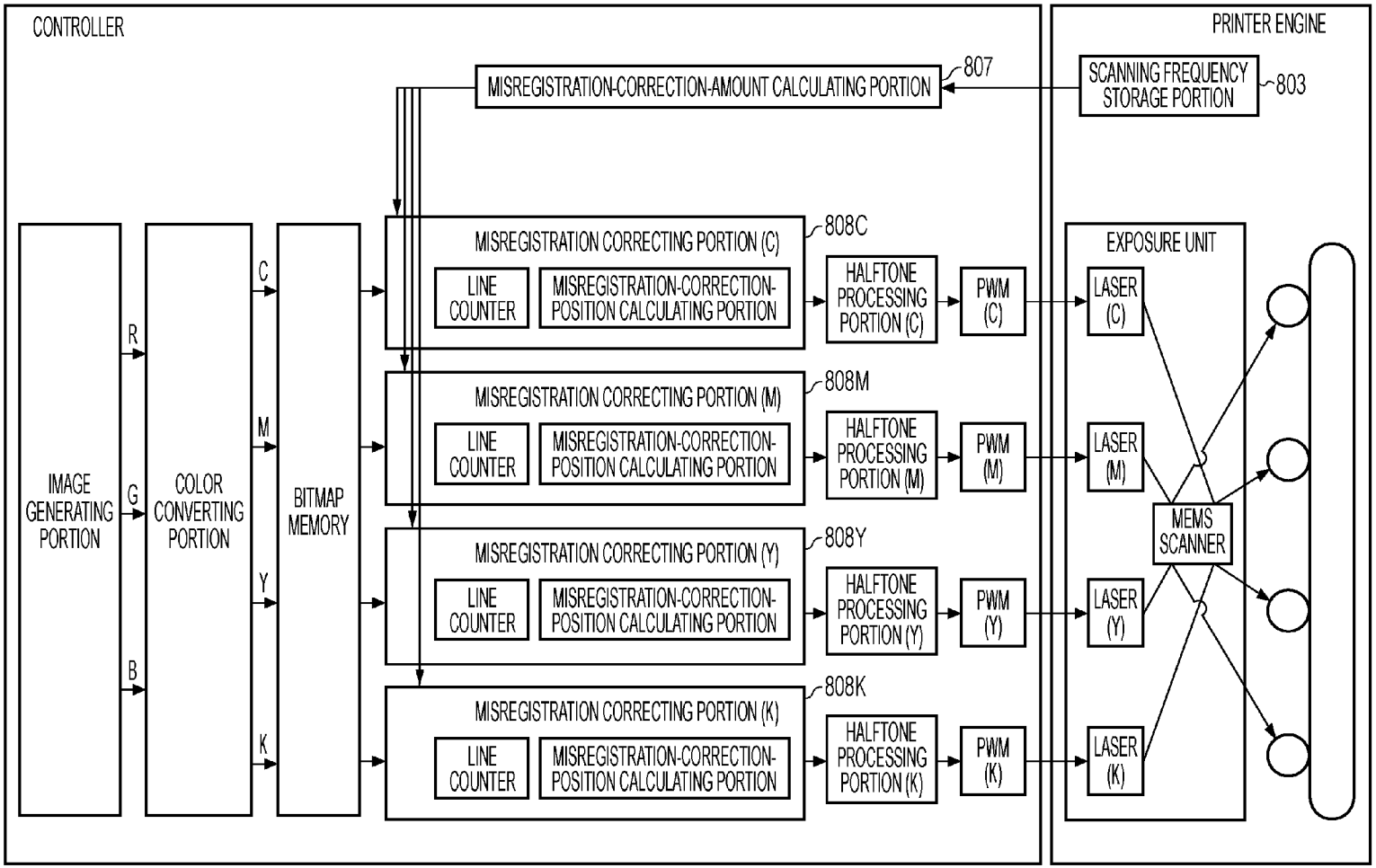
FIG. 8 is a logical block diagram showing control of an exposure unit according to a third embodiment of the present invention.

FIG. 8 is a logical block diagram showing control of an exposure unit according to the third embodiment.

A misregistration-correction-amount calculating portion 807 calculates the enlargement or reduction factor in the sub-scanning direction from the information about the scanning frequency stored in a scanning frequency storage portion 803. More specifically, the misregistration-correction-amount calculating portion 807 calculates the enlargement or reduction factor (correction amount) that makes the sub-scanning widths of the colored images formed by the exposure units for C, M, Y, and K match the sub-scanning width corresponding to the ideal scanning frequency preliminarily stored in a storage section (not shown) of the image forming apparatus. Then, the calculated enlargement or reduction factor is output to misregistration correcting portions 808. Herein, the "ideal frequency" means a scanning frequency at which image data is output with a designated aspect ratio, which usually depends on the rotational speed of the photosensitive drums 14.

More specifically, where the scanning frequency of the MEMS scanner corresponding to C, M, Y, and K is CMYK_T (kHz), and the ideal scanning frequency is I_T (kHz), the enlargement or reduction factor CMYK_S is expressed as follows:

$$CMYK_S=CMYK_T/I_T$$

The misregistration correcting portions 808 generate image data for correcting the scanning frequency of the MEMS scanner. This allows the image data to be generated with a more accurate aspect ratio. More specifically, using the bitmap data stored in a bitmap memory 306 and the enlargement or reduction factor input from the misregistration-correction-amount calculating portion 307, the misregistration correcting portions 808 generate image signals enlarged or reduced in the sub-scanning direction.

As has been described, the image forming apparatus according to the third embodiment uses the sub-scanning width corresponding to the preliminarily stored ideal frequency as the reference, and enlarges or reduces the image data of C, M, Y, and K in the sub-scanning direction, to reduce distortion of the aspect ratio, i.e., to reduce the influence of variation in scanning frequency among MEMS scanners due to individual differences on image formation.

Mdoification Example 4

The image forming apparatus according to the third embodiment has one MEMS scanner concurrently shared by laser beams corresponding to C, M, Y, and K coloring materials. An image forming apparatus according to Modification Example 4 has one MEMS scanner sequentially shared by laser beams corresponding to C, M, Y, and K coloring materials. The image forming apparatus according to Modification Example 4 uses a plurality of developers to develop color images on one photosensitive body, and repeatedly performs a process including exposure, development, and transfer to superimpose the color images on a sheet of transfer material.

Figure 9:
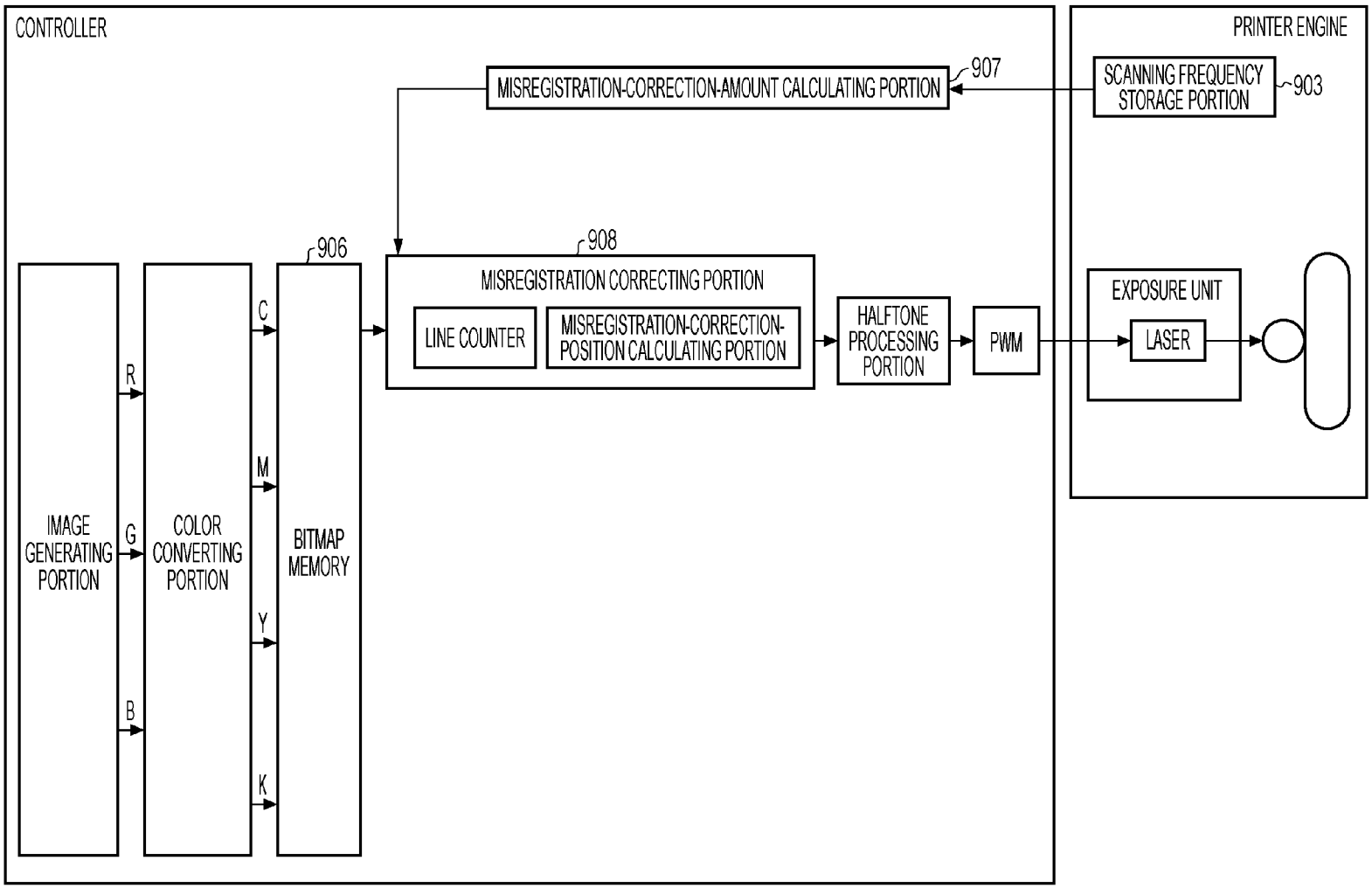
FIG. 9 is a logical block diagram showing control of an exposure unit of a color image forming apparatus according to Modification Example 4.

FIG. 9 is a logical block diagram showing control of an exposure unit of a color image forming apparatus according to Modification Example 4.

A misregistration-correction-amount calculating portion 907 calculates the enlargement or reduction factor in the sub-scanning direction from the information about the scanning frequency stored in a scanning frequency storage portion 903. More specifically, the misregistration-correction-amount calculating portion 907 calculates the enlargement or reduction factor (correction amount) that makes the sub-scanning width of the image formed by the exposure unit of black (K) match the sub-scanning width corresponding to the ideal scanning frequency preliminarily stored in a storage section (not shown) of the image forming apparatus. Then, the calculated enlargement or reduction factor is output to a misregistration correcting portion 908.

The misregistration correcting portion 908 generates image data for correcting the scanning frequency of the MEMS scanner. This allows the image data to be generated with a more accurate aspect ratio. More specifically, the misregistration correcting portion 908 generates an image signal enlarged or reduced in the sub-scanning direction, using the bitmap data stored in a bitmap memory 906 and the enlargement or reduction factor input from the misregistration-correction-amount calculating portion 907.

Modification Example 5

The image forming apparatus according to the third embodiment is a color image forming apparatus. An image forming apparatus according to Modification Example 5 is a monochrome image forming apparatus.

Figure 10:
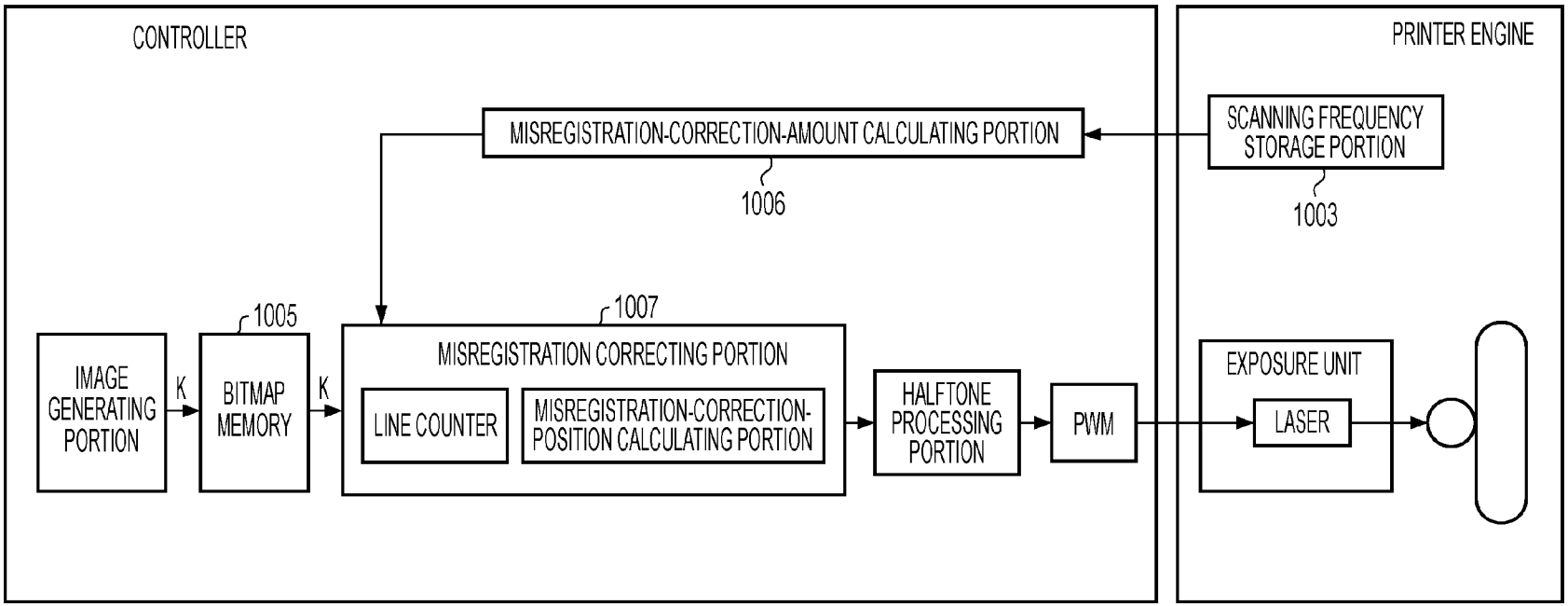
FIG. 10 is a logical block diagram showing control of an exposure unit of a monochrome image forming apparatus according to Modification Example 5.

FIG. 10 is a logical block diagram showing control of an exposure unit of a monochrome image forming apparatus according to Modification Example 5.

A misregistration-correction-amount calculating portion 1006 calculates the enlargement or reduction factor in the sub-scanning direction from the information about the scanning frequency stored in a scanning frequency storage portion 1003. More specifically, the misregistration-correction-amount calculating portion 1006 calculates the enlargement or reduction factor (correction amount) that makes the sub-scanning width of the image formed by the exposure unit of black (K) match the sub-scanning width corresponding to the ideal scanning frequency preliminarily stored in a storage section (not shown) of the image forming apparatus. Then, the calculated enlargement or reduction factor is output to a misregistration correcting portion 1007.

The misregistration correcting portion 1007 generates image data for correcting the scanning frequency of the MEMS scanner. This allows the image data to be generated with a more accurate aspect ratio. More specifically, the misregistration correcting portion 1007 generates an image signal enlarged or reduced in the sub-scanning direction, using the bitmap data stored in a bitmap memory 1005 and the enlargement or reduction factor input from the misregistration-correction-amount calculating portion 1006.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-203401 filed Aug. 3, 2007, which is hereby incorporated by reference herein in its entirety.

What is claimed is:

1. An image forming apparatus comprising:

an oscillating device configured to oscillate at a natural frequency;

a laser beam device configured to emit a laser beam;

a photoconductive drum, the oscillating device configured to scan the laser beam from the laser beam device across the photoconductive drum;

a device-information storage unit configured to store a scanning frequency of the oscillating device;

an image storage unit configured to store image data used for image formation;

an image processing unit configured to perform an enlargement or reduction, in a direction orthogonal to a direction of the scanning of the laser beam and in accordance with a parameter, on the image data stored in the image storage unit;

a setting unit configured to calculate the parameter from the scanning frequency stored in the device-information storage unit and a predetermined reference frequency and configured to set the parameter in the image processing unit; and a driving unit configured to drive the laser beam device according to the image data processed by the image processing unit.

2. The image forming apparatus according to claim 1, wherein the parameter is a difference between a sub-scanning width corresponding to the scanning frequency stored in the device-information storage unit and a sub-scanning width corresponding to the predetermined reference frequency.

3. The image forming apparatus according to claim 1, wherein the parameter is a ratio of the scanning frequency stored in the device-information storage unit to the predetermined reference frequency.

4. The image forming apparatus according to claim 1, wherein the image processing unit performs an overlapping interpolation process of a line image signal during the enlargement and performs a decimation process of a line image signal during the reduction.

5. The image forming apparatus according to claim 1, wherein the image processing unit performs the enlargement or reduction by linear interpolation between adjacent line signals.

6. The image forming apparatus according to claim 1, wherein the image forming apparatus is a color image forming apparatus that uses a plurality of coloring materials to form a color image, wherein the image forming apparatus has a plurality of such oscillating device, the plurality including an oscillating device corresponding to a black coloring material, and wherein the setting unit uses the frequency of the oscillating device corresponding to the black coloring material as the predetermined reference frequency.

7. The image forming apparatus according to claim 1, wherein the image forming apparatus is a color image forming apparatus that uses a plurality of coloring materials to form a color image, wherein the image forming apparatus has a plurality of such oscillating device, the plurality including an oscillating device closest to a second reference frequency, and wherein the setting unit uses the frequency of the oscillating device closest to the second reference frequency as the predetermined reference frequency.

8. The image forming apparatus according to claim 1, wherein the image forming apparatus is a color image forming apparatus that uses a plurality of coloring materials to form a color image, wherein the image forming apparatus has a plurality of the oscillating device, and wherein the setting unit uses the highest or lowest frequency among the frequencies of the oscillating devices as the predetermined reference frequency.

9. The image forming apparatus according to claim 1, wherein the oscillating device is a MEMS scanner that cyclically oscillates about an axis.

10. The image forming apparatus according to claim 1, wherein the image processing unit performs the enlargement or reduction in response to the given parameter exceeding a predetermined range.

11. The image forming apparatus according to claim 1, further comprising a measuring unit configured to measure the frequency of the oscillating device at a predetermined timing and store the frequency in the device-information storage unit.

12. A method for forming an image using an image forming apparatus, the image forming apparatus comprising: an oscillating device configured to oscillate at a natural frequency; a laser beam device configured to emit a laser beam; a photoconductive drum, the oscillating device configured to scan the laser beam from the laser beam device across the photoconductive drum; a device-information storage unit; an image storage unit; an image processing unit; a setting unit, and a driving unit; the method comprising:

storing a scanning frequency of the oscillating device in the device-information storage unit;

storing image data used for image formation in the image storage unit;

using the image processing unit to perform an enlargement or reduction, in a direction orthogonal to a direction of the scanning of the laser beam and in accordance with a parameter, on the image data stored in the image storage unit;

using the setting unit to calculate the parameter from the scanning frequency stored in the device-information storage unit and a predetermined reference frequency and configured to set the parameter in the image processing unit; and using the driving unit to drive the laser beam device according to the image data processed by the image processing unit.

13. A non-transitory computer-readable storage medium that stores a program of computer-executable code executable by a computer to form an image using an image forming apparatus, the image forming apparatus comprising: an oscillating device configured to oscillate at a natural frequency; a laser beam device configured to emit a laser beam; a photoconductive drum, the oscillating device configured to scan the laser beam from the laser beam device across the photoconductive drum; a device-information storage unit; and an image storage unit; the program of computer-executable code comprising:

computer-executable code for storing a scanning frequency of the oscillating device in the device-information storage unit;

computer-executable code for storing image data used for image formation in the image storage unit;

computer-executable image processing code for performing an enlargement or reduction, in a direction orthogonal to a direction of the scanning of the laser beam and in accordance with a parameter, on the image data stored in the image storage unit;

computer-executable code for calculating the parameter from the scanning frequency stored in the device-information storage unit and a predetermined reference frequency and configured to set the parameter for use by the computer-executable image processing code; and computer-executable code for driving the laser beam device according to the image data processed by the computer-executable image processing code.

* * * * *